US007033290B1

(12) United States Patent
Coldren

(10) Patent No.: US 7,033,290 B1
(45) Date of Patent: Apr. 25, 2006

(54) SPORTS TRAINING ASSEMBLY AND A METHOD FOR USING THE SAME

(76) Inventor: Joseph Michael Coldren, 7398 Spring Oak Ct., West Bloomfield, MI (US) 48324

( * ) Notice: Subject to any disclaimer, the term of this patent is extended or adjusted under 35 U.S.C. 154(b) by 80 days.

(21) Appl. No.: 10/763,660

(22) Filed: Jan. 23, 2004

(51) Int. Cl.
*A63B 69/00* (2006.01)

(52) U.S. Cl. ..... 473/453; 472/422

(58) Field of Classification Search ..... 473/414, 473/428, 423, 453, 451, 422, 430, 424, 425, 473/426, 427, 429, 506, 507, 508, 615, 450; 273/329, 330, 451, 453, 331–335; 482/91, 482/110

See application file for complete search history.

(56) References Cited

U.S. PATENT DOCUMENTS

| | | | | |
|---|---|---|---|---|
| 708,573 | A | 9/1902 | Miles | |
| 3,092,408 | A * | 6/1963 | Berman | 403/306 |
| 3,301,556 | A | 1/1967 | Hamilton et al. | |
| 4,630,550 | A * | 12/1986 | Weitzman | 108/155 |
| 4,735,413 | A | 4/1988 | Yamanouchi et al. | |
| 4,784,389 | A | 11/1988 | Taylor | |
| 4,944,513 | A * | 7/1990 | Zentner | 473/428 |
| 4,966,367 | A * | 10/1990 | Oyarzabal | 473/426 |
| 5,213,324 | A | 5/1993 | Bowers | |
| 5,228,683 | A | 7/1993 | Beimel | |
| 5,288,083 | A * | 2/1994 | Palmieri | 273/329 |
| 5,340,101 | A | 8/1994 | Lawson et al. | |
| 5,415,396 | A | 5/1995 | Huang | |
| 5,588,646 | A | 12/1996 | Dickson | |
| 5,873,798 | A * | 2/1999 | Bostick | 473/426 |
| 6,042,491 | A * | 3/2000 | Dixon, Jr. | 473/423 |
| 6,223,358 | B1 * | 5/2001 | DePietro | 4/498 |
| 6,461,255 | B1 | 10/2002 | Smith | |
| 6,565,462 | B1 | 5/2003 | Gregg | |

OTHER PUBLICATIONS

Web Page, The display centre, Feb. 24, 2001, www.displaycentre.co.uk/directory/grails.htm, 12 pages.*
Web Page, Unistrut, Jul. 19, 2002, www.warninglitesofalaska.com/uni/telespar2.htm, 5 pages.*

* cited by examiner

*Primary Examiner*—Eugene Kim
*Assistant Examiner*—M. Chambers
(74) *Attorney, Agent, or Firm*—Law Offices of John Chupa and Associates, P.C.

(57) ABSTRACT

A sports training assembly (10) and a method for using the assembly (10) to increase hand-eye coordination and muscle memory. Particularly, the sports training assembly (10) includes a bat portion (70) having a channel (76) formed therein, wherein the channel (76) cooperates with a guide wire (60) having a ball portion (26) movably coupled thereon, and wherein a user (90) may repeatedly swing the bat portion (70) along a proper swing line (100), thereby allowing the user (90) to increase hand-eye coordination and gain muscle memory for reproducing the proper swing line (100) in a game situation.

11 Claims, 2 Drawing Sheets

SPORTS TRAINING ASSEMBLY AND A METHOD FOR USING THE SAME

FIELD OF THE INVENTION

The present invention generally relates to a sports training assembly and a method for using the same and, more particularly, a sports training assembly which allows an individual to train his/her muscles to remember a proper swing line through repeditory muscle training and visual reinforcement, thereby allowing an individual to perform a proper swing in a game situation after utilizing the sports training assembly in a non-game situation.

BACKGROUND OF THE INVENTION

It is well known that a proper swing and good hand eye coordination are essential elements for any baseball/softball player to possess in order to be a successful batter. There are many batting training/practice devices which are commercially available that allow a batter to practice these various elements. For example and without limitation, one well known training/practice device involves a ball which is coupled to a pair of tethers, and which is designed to be coupled to a desired object, such as a tree or a basketball pole.

Particularly, this well known training/practice device allows a batter to repeatedly swing a baseball/softball bat at a slowly moving target (i.e., the ball attached to the tethers). Once the ball has been struck by the bat, the ball forces the tethers to wrap around the desired object and, upon the tethers becoming fully wrapped around the desired object, the ball then recoils or returns along the path at which it was propelled (i.e., struck by the bat), thereby allowing the user to swing the bat at the slowly moving target over and over again. The objectives sought by this well known training/practice device, which are commercially advertised, are to provide hand-eye coordination.

Although this well known training/practice device may increase a batter's hand-eye coordination upon repeated use, this well known device does suffer from some drawbacks. For example and without limitation, this training/practice device does not allow for a batter to repeatedly practice/train the muscles in their body to correctly reproduce a desired swing line. That is, this device allows a user or batter to contact the ball despite the fact that the batter may be utilizing an improper swing line or improper form. If the batter strikes the bottom of the ball, the ball will continue to wrap around the desired object. Likewise, if the batter strikes the top of the ball, the ball will continue to wrap around the desired object, thereby allowing a batter to practice/train batting with an improper swing line while concomitantly deceiving the batter that he/she is practicing a correct swing and training the muscles of the batter to remember an incorrect swing line. Moreover, this device is not designed to be utilized indoors in a conventional home.

In further example and without limitation, a well known methodology for increasing hand-eye coordination for a batter involves a batter placing a baseball/softball bat upon his/her shoulder, removing one hand from the bat, utilizing the removed hand to toss a ball vertically in the air, placing the removed hand back upon the bat, and swinging at the ball which is descending towards the ground. This known methodology may improve hand-eye coordination but it does suffer from some drawbacks.

That is, this known methodology does not allow a user to practice a correct swing line or train correct muscle memory for a correct swing line (i.e., the user may strike the ball with an improper swing), does not allow a user to practice a correct stance, does not allow a user enough time to practice a correct swing before the ball hits the ground, and does not allow a user to repeatedly practice the same certain desired swing line (e.g., a home-run swing line, a line-drive swing line, or a ground-ball swing line). Moreover, this well known methodology may not be conducive to indoor training. That is, conventional homes typically do not include a surface area or wall that may be repeatedly struck by a baseball or softball without suffering from damage. Also, conventional homes do not include a ceiling that is high enough to afford an individual enough time to toss a ball into the air and prepare to swing a bat properly.

In final example and without limitation, one well known methodology for increasing hand-eye coordination involves the utilization of conventional batting cages, wherein a machine propels a ball at a batter and allows the batter to swing at the propelled ball. Although conventional batting cages may increase hand-eye coordination, they do suffer from some drawbacks. That is, conventional batting cages do not allow a user to practice a correct swing line (i.e., the user may strike the ball with an improper swing), does not allow a batter to practice timing and muscle memory because the batter only knows when to swing the bat after the ball has been propelled towards them (i.e., there is substantially no warning that the next pitch is coming in a conventional batting cage), and does not allow a user to repeatedly practice the same certain desired swing line (e.g., a home-run swing line, a line-drive swing line, or a ground-ball swing line) because conventional batting cages do not reproduce the same exact pitch every time. Rather, conventional batting cages oftentimes propel the balls towards the batter at a different angle; height, speed, spin, and/or the like every single pitch, thereby obviating practicing the exact same swing line every single time. Moreover, construction of a conventional batting cage within the interior of a conventional home requires a substantial amount of space within the home, a substantial amount of expenditure to build, and is typically too large to fit within a conventional home.

There is therefore a need for an assembly which allows a batter to train/practice a proper swing line in an effective manner. There is still a further need for an assembly which allows an individual to train/practice a proper swing line inside substantially any desired structure as well as outdoors. There is also a need for an assembly which allows a batter to increase hand-eye coordination and muscle memory for a correct swing line in a manner which overcomes some or all of the previously delineated drawbacks of prior sports training/practicing assemblies and methodologies.

SUMMARY OF THE INVENTION

A first non-limiting advantage of the present invention is that it provides an assembly which allows for the selective and repeated correct swing line in a manner which overcomes the previously delineated drawbacks of prior sports training/practice assemblies.

A second non-limiting advantage of the invention is that it provides a sports training/practice assembly which allows a batter to increase hand-eye coordination while concomitantly allowing the batter to develop muscle memory for a correct swing and a correct swing line.

A third non-limiting advantage of the present invention is that it provides an assembly which allows an individual to train/practice a correct swing line in substantially any desired structure as well as outdoors.

A fourth non-limiting advantage of the present invention is that it provides a method for using a sports training/practice assembly to increase hand-eye coordination and muscle memory.

A fifth non-limiting advantage of the present invention is that it provides a training assembly comprising a bat portion having a channel formed therein, wherein the channel lies on a longitudinal axis of symmetry of the bat portion.

A sixth non-limiting advantage of the present invention is that it provides an assembly comprising a frame portion having at least two wire containment pin portions; a ball portion having an aperture formed therethrough; a guide wire portion which is disposed through the aperture of the ball portion, the guide wire portion including two substantially identical attachment portions, the two substantially identical attachment portions each being disposed upon a unique end of the guide wire portion; and a bat portion having a handle end and a striking end, wherein the striking end includes a channel portion.

A seventh non-limiting advantage of the present invention is that it provides a method for using a sports training/practice assembly to increase hand-eye coordination and muscle memory. Particularly, the method comprises the steps of providing a frame portion having at least two wire containment pin portions; providing a ball portion having an aperture formed therethrough; providing a guide wire portion and movably disposing the guide wire portion through the aperture of the ball portion; providing two substantially identical attachment portions and coupling the two substantially identical attachment portions to a unique end of the guide wire portion; providing a bat portion having a handle end, a striking end, and a longitudinal axis of symmetry; forming a channel portion on the longitudinal axis of symmetry of the bat portion and through the striking end; suspending the guide wire portion between the frame portion; and repeatedly swinging the bat portion at the ball portion, such that the channel portion of the bat portion receives the guide wire portion and allows the bat portion to strike the ball portion, effective to repeatedly practice a correct swing and gain muscle memory from the correct swing.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

The present invention may be understood more readily by reference to the following detailed description of preferred embodiments of the invention.

Before the present methods and apparatuses are disclosed and described, it is to be understood that the terminology used herein is for the purpose of describing particular embodiments only and is not intended to be limiting. It must be noted that, as used in the specification and the appended claims, the singular forms "a", "an", and "the" include plural referents unless the context clearly dictates otherwise.

Figure 1:
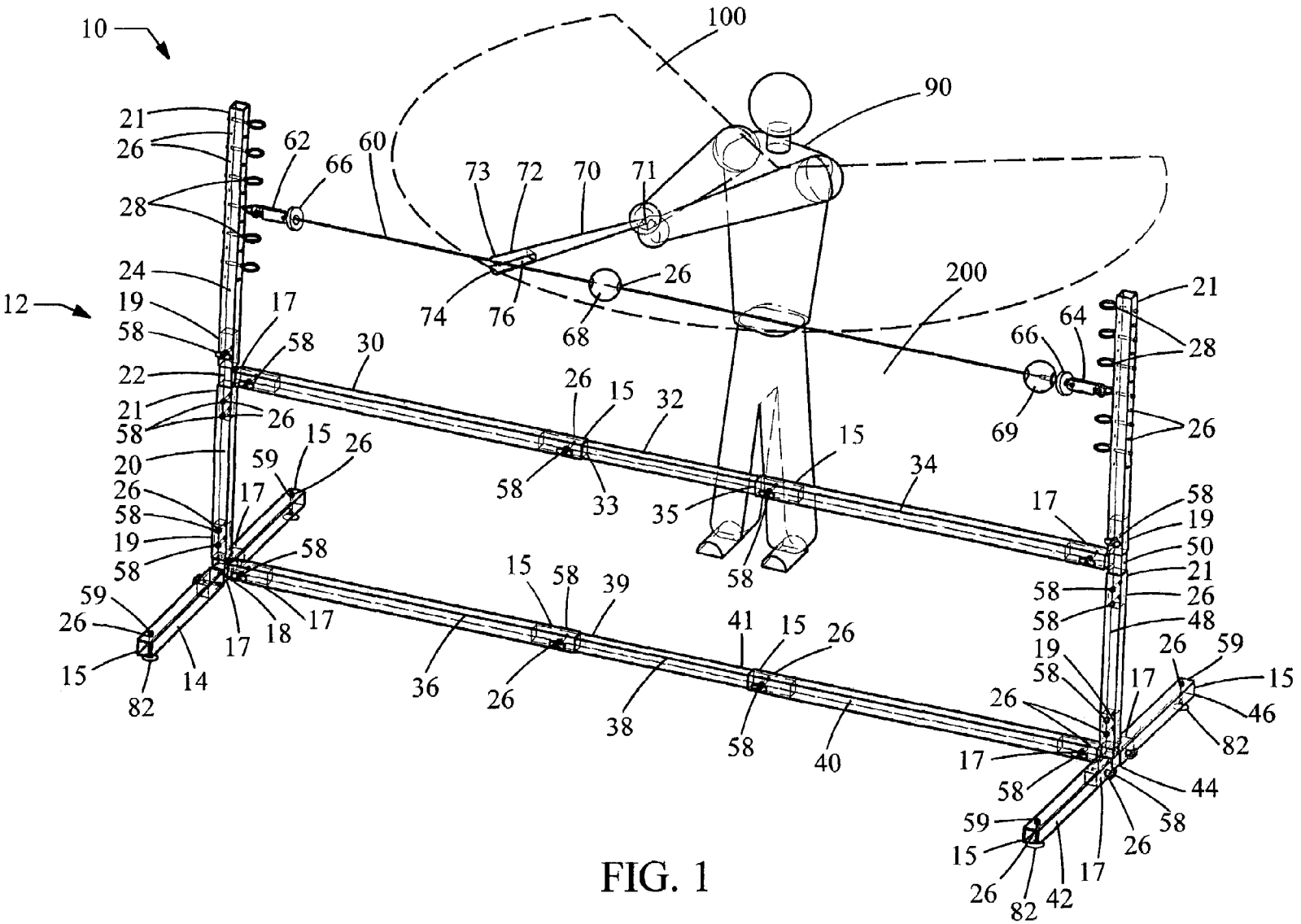
FIG. 1 is a partial perspective view of a sports training assembly which is made in accordance with the teachings of the preferred embodiment of the invention.

Referring now to FIG. 1, there is shown a sports practice/training assembly 10 which is made in accordance with the teachings of the preferred embodiment of the invention. As shown, the sports practice assembly 10 includes a frame portion 12, a cable portion 60, and a bat portion 70. Particularly, the frame portion 12 includes a first leg portion 14 having a pair of substantially identical apertures 26 formed therethrough. That is, the first leg portion 14 is generally hollow and includes an aperture 26 through an outside end 15 and an aperture 26 through an inside end 17. The frame portion 12 further includes a second leg portion 16 which is substantially identical to the first leg portion 14, and which includes a pair of substantially identical apertures 26 formed therethrough. That is, the second leg portion 16 is generally hollow and includes an aperture 26 through an outside end 15 and an aperture 26 through an inside end 17.

The frame portion 12 further includes a third leg portion 42 which is substantially identical to the first and second leg portions 14, 16, and which includes a pair of substantially identical apertures 26 formed therethrough. That is, the third leg portion 42 is generally hollow and includes an aperture 26 through an outside end 15 and an aperture 26 through an inside end 17. The frame portion 12 also includes a fourth leg portion 46 which is substantially identical to the first, second, and third leg portions 14, 16, 42 and which includes a pair of substantially identical apertures 26 formed therethrough. That is, the fourth leg portion 46 is generally hollow and includes an aperture 26 through an outside end 15 and an aperture 26 through an inside end 17. It should be understood that each respective leg portion 14, 16, 42, 46 which is described herein utilizes the same reference numerals for the apertures 26, the inside ends 17, and the outside ends 15 due to the fact that each respective leg portion 14, 16, 42, 46 is identical to each respective other leg portion 14, 16, 42, 46 (i.e. like components are described using like reference numerals).

In one non-limiting embodiment of the present invention, each respective leg portion 14, 16, 42, 46 may include an anti-skid pin portion 59. That is, the term anti-skid hereinafter means a non-marking and malleable material, such as and without limitation, rubber which is coupled to a conventional pin, bolt, and/or the like. Each respective anti-skid pin portion 59 may be disposed through each respective aperture 26 which has been formed at the outside end 15 of each respective leg portion 14, 16, 42, 46, such that the malleable portion of the anti-skid pin portion 59 is disposed beneath the leg portions 14, 16, 42, 46 (i.e., each leg portion 14, 16, 42, 46 will rest upon the malleable portion of each respective anti-skid pin portion 59 when each respective leg portion 14, 16, 42, 46 is placed upon an interior surface within a desired structure or upon exterior surface, such as grass, dirt, sand, and/or the like). It should be appreciated that the assembly 10 may be utilized both indoors and outdoors without adaptation or modification to the assembly 10. In other non-limiting embodiments of the present invention, to facilitate both indoor and outdoor usage, the assembly 10 may also include pin portions (not shown) which are shape substantially similar to conventional tent spikes (not shown). These "outdoor" pin portions (not shown) may be either interchangeable with the pin portions 59 or coexists with the pin portions 59 (i.e., the pin portions 59 may be selectively removable from the frame portion 12 or be selectively adjustable to allow an individual to select either the pin portions 59 or the outdoor pin portions (not shown), dependant upon the surface upon which the user desires to utilize the assembly 10). In this manner, the assembly 10 may be securely and removably held within one position upon an outdoor surface, such as dirt, grass, sand, earth, and/or the like while the assembly 10 is being utilized, thereby obviating any undesirable shifting of position relative to a batter or user, such as user 90.

The frame portion 12 further includes a first generally hollow base rail portion 36 and a second generally hollow base rail portion 40. Particularly, the first generally hollow base rail portion 36 has a pair of apertures 26 formed therethrough. That is, the first base rail portion 36 has an aperture 26 formed through an inside end 17 and a second aperture formed through an outside end 15. The second generally hollow base rail portion 40 also includes a pair of apertures 26 formed therethrough. That is, the second base rail portion 40 has an aperture 26 formed through an inside end 17 and a second aperture formed through an outside end 15. It should be understood that the first and the second generally hollow base rail portions 36, 40 are identical.

The frame portion 12 also includes a first generally hollow support rail portion 30 and a second generally hollow support rail portion 34. Particularly, the first generally hollow support rail portion 30 has a pair of apertures 26 formed therethrough. That is, the first generally hollow support rail portion 30 has an aperture 26 formed through an inside end 17 and a second aperture formed through an outside end 15. The second generally hollow support rail portion 34 also includes a pair of apertures 26 formed therethrough. That is, the second generally hollow support rail portion 34 has an aperture 26 formed through an inside end 17 and a second aperture formed through an outside end 15. It should be understood that the first and the second generally hollow support rail portions 30, 34 are identical. It should also be understood that the first and second generally hollow base rail portions 36, 40 are identical to the first and the second generally hollow support rail portions 30, 34. In this manner and, as will be discussed in greater detail below, the base rail portions 36, 40 are completely interchangeable with the support rail portions 30, 34, thereby providing an assembly which is both relatively cost effective to manufacture as well as substantially simple for a user to set up.

Frame portion 12 also includes a first and a second attachment rail 32, 38. It should be understood that the first and second attachment rails 32, 38 are geometrically configured to be received by and frictionally fit within each of the base rail portions 36, 40 and within each of the support-rail portions 30, 34 (i.e., the first and the second attachment rails 32, 38, are smaller than each of the rails 36, 40, 30, 34), as will be discussed in detail below. The first attachment rail 38 includes a pair of substantially identical apertures 26 formed through a first end 39 and a second end 41. The second attachment rail 32 also includes a pair of substantially identical apertures 26 formed through a first end 33 and a second end 35.

Figure 2:
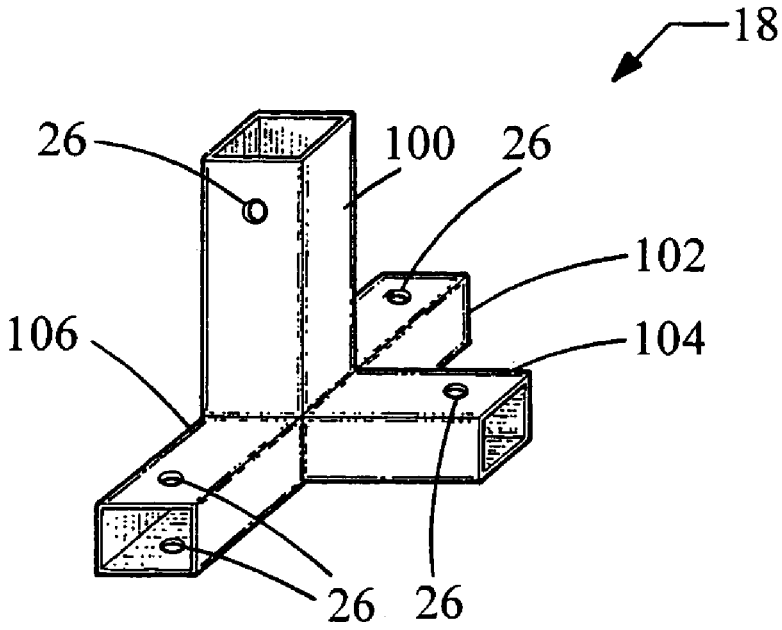
FIG. 2 is a partial perspective view of a portion of the sports training assembly which is shown in FIG. 1.

The frame portion 12 further includes a first-four way connector portion 18 and a second four way connector portion 44. Particularly, the first-four way connector portion 18, as best shown in FIG. 2, includes a vertical connector 100 having an aperture 26 formed therethrough, a first leg connector 102 having an aperture formed therethrough, a second leg connector 104 having an aperture 26 formed therethrough, and a third leg connector 106 having an aperture 26 formed therethrough. It should be appreciated that the first, second, and third leg connectors 102, 104, 106, are perpendicular to the vertical leg connector 100. It should also be appreciated that the first and second leg connectors 102, 104 form a ninety degree angle, the second and third leg connectors 104, 106 form a ninety degree angle, and the first and third leg connectors 102, 106 form a one-hundred and eighty degree angle. It should be understood that the first and the second four-way connector portions 18, 44 are identical and, therefore the description of the second four-way connector portion 44 is identical to the description of the first four-way connector portion 18.

Figure 3:
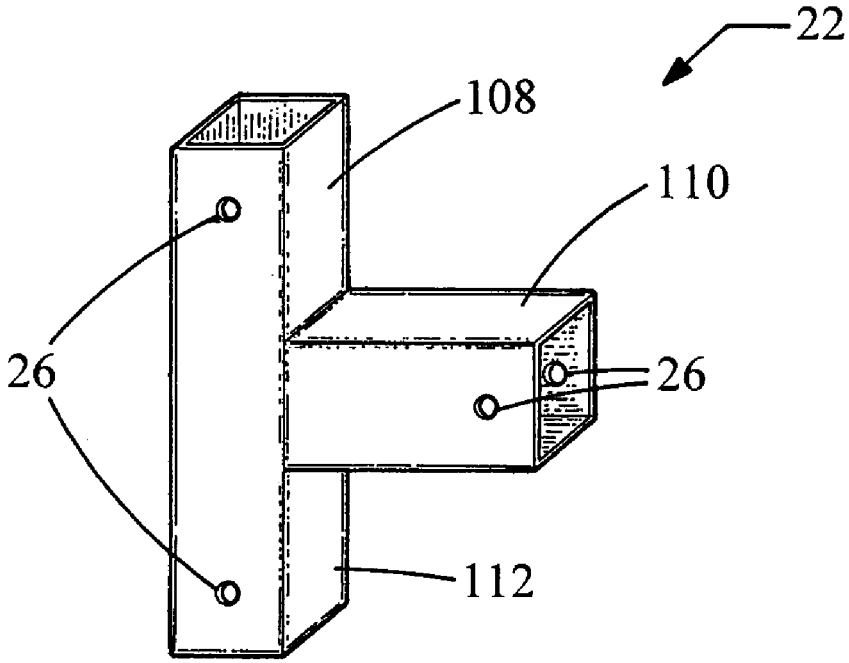
FIG. 3 is a partial perspective view of a portion of the sports training assembly which is shown in FIG. 1.

The frame portion 12 also includes a pair of identical three-way connector portions 22, 50. The first three-way connector portion 22 (i.e., first out of two), as best shown in FIG. 3, includes a first vertical post connector portion 108 having an aperture 26 formed therethrough, a second vertical post connector portion 112 having an aperture 26 formed therethrough, and a support connector portion 110 having an aperture 26 formed therethrough, wherein the support connector is disposed upon the first and the second vertical post connectors 108, 112 at a ninety degree angle (i.e., the support connector 110 is perpendicular to the first and the second vertical post connectors 108, 112). It should be understood that the second (i.e., second of the pair of identical three-way connector portions 22, 50) three-way connector portion 50 is identical to the first three-way connector portion 22, therefore description of the second three-way connector 50 is identical to the description of the first three-way connector portion 22.

The frame portion 12 further includes a first post portion 20 and a second identical post portion 48. The first post portion 20 includes a pair of substantially identical apertures 26 formed therethrough. That is, the first post portion 20 includes an aperture 26 formed through a bottom end 19 and a second aperture formed through a top end 21. Likewise, the second post portion 48 includes a pair of substantially identical apertures 26 formed therethrough. That is, the second post portion 48 includes an aperture 26 formed through a bottom end 19 and a second aperture formed through a top end 21.

The frame portion 12 also includes a first wire post portion 24 and a second identical wire post portion 52. Particularly, the first wire post portion 24 includes a plurality of equidistantly spaced apertures 26 formed therethrough and a plurality of wire retaining pins 28, each of which are disposed within a respective one of the plurality of apertures 26. The first wire post portion also includes a pair of identical apertures 26 formed therethrough. That is, the first wire post portion 24 has an aperture formed through a bottom end 19 and an aperture 26 formed through a top end 21. The second wire post portion 52 includes a plurality of equidistantly spaced apertures 26 formed therethrough and a plurality of wire retaining pins 28, each of which are disposed within a respective one of the plurality of apertures 26. The second wire post portion also includes a pair of identical apertures 26 formed therethrough. That is, the second wire post portion 24 has an aperture formed through a bottom end 19 and an aperture 26 formed through a top end 21.

In one non-limiting embodiment of the present invention, each generally hollow component 14, 16, 18, 20, 22, 24, 30, 32, 34, 36, 38, 40, 42, 44, 46, 48, 50, and 52 of the frame portion 12 may further include a selectively expandable material, such as elastic, rubber, or the like, which is threaded through each of the above-mentioned components. That is, the frame portion 12 may include this selectively expandable material throughout the entire frame portion 12 and, in this manner, a user may quickly and easily assemble the frame portion 12 by coupling adjacent pieces or components until the frame portion is completely coupled. Moreover, in this non-limiting embodiment, the frame portion 12 may be quickly and easily disassembled while concomitantly preventing each of the aforementioned components of the frame portion 12 from being disassociated from the respective components to which they will be coupled.

The guide wire portion 60 includes a pair of substantially identical spring portions 62, 64, each of which being fixedly coupled to the guide wire at a respective end and, in one non-limiting embodiment of the present invention, each respective spring portion 62, 64 is coupled to a unique one of the wire post portions 24, 52 between the generally "U-shaped" frame portion 12 and above the void area 200. The guide wire 60 also includes a pair of identical stopper disks 66 which the guide wire 60 traverses through. Particularly, each respective stopper disks 66 is disposed on the guide wire 60 at a respective end and between the pair of spring portions 62, 64. The wire portion further includes a ball portion 68 having an aperture 26 formed therethrough. Particularly, the guide wire 60 is disposed through the aperture 26 of the ball portion 68, such that the ball portion 68 may freely traverse the guide wire 60 from a respective one of the stopper disks 66 to the respective other stopper disk 66. It should be understood that the term "stopper disk" refers to any and all known motion dampening or motion retardation devices, such as and without limitation, rubber balls or substantially any desired malleable material. It should further be understood that nothing within this description of preferred and alternate embodiments is meant to or should be construed as limiting the geometrical configuration of the stopper disks 66 to a conventional "disk" shape or geometrical configuration. Rather, the stopper disks may be configured utilizing substantially any desired geometrical configuration, such as and without limitation, cubic, spherical, triangular, conical, and/or the like.

The assembly 10 further includes a bat portion 70 which is adapted to strike the ball portion 68 upon a correctly executed swing path 100 by a user 90. The bat portion 70 is substantially identical to a conventional baseball/softball bat (i.e., the bat portion includes a conventional handle portion 71 and is shaped substantially similar to conventional baseball/softball bats), with the exception that a channel 76 if formed into the bat 70 at the end 73 which strikes the ball 68. That is, a channel 76 is formed through the bat 70 at the striking end 73 of the bat, such that the channel 76 lies on a longitudinal axis of symmetry of the bat 70. The formation of this channel 76 creates two substantially parallel ball striking surfaces 72, 74.

In set-up and operation, a user 90 may lay out all of the above described components of the frame portion 12 in a manner which the user may easily identify and locate each of the various components. Next, the user 90 may locate and dispose the first and second four-way connector portions 18, 44 upon a desired surface, such as and without limitation, a gymnasium floor. Next, the user would locate any two of the four respective leg portions 14, 16, 42, 46, dispose one the respective two leg portions 14, 16, 42, 46 upon the leg connector portion 102, and dispose the remaining leg portion 14, 16, 42, 46 of the two leg portions 14, 16, 42, 46 upon the leg connector portion 106. At this time, the user may dispose a pin portion 58 through the apertures 26 of the leg.

Next, the user 90 would perform the same operation as described above with the remaining two leg portions 14, 16, 42, 46 (i.e., the remaining two leg portions out of the four respective leg portions 14, 16, 42, 46 with the second four-way connector portion 44. At this time, the user may dispose a pin portion 58 through the apertures 26 of the leg portions 14, 16, 42, 46 and through the apertures 26 of the first and second leg connector portions 102, 106 of the first and second four-way connector portions 18, 44, thereby preventing the leg portions 12, 14, 42, 46 from disengaging the four-way connector portions 18, 44. Next, the user 90 would locate the first and the second base rail portions 36, 38 and dispose a respective one of the base rail portions upon the base rail connector portion 104 of the first four-way connector portion 18 and dispose the remaining respective one of the base rail portions upon the base rail connector portion 104 of the second four-way connector portion 44. The user 90 then may dispose pin portions 58 through the outside end 15 apertures 26 of the base rail portions 36, 40, and through the apertures 26 of the base rail connector portions 104, thereby preventing the base rail portions 36, 40 from disengaging from the four-way connector portions 18, 44.

The user 90 then would locate a respective one of the attachment rails 38, 32 and dispose it within the outside ends 15 of the base rail portions 36, 40, thereby coupling the base rail portions 36, 40 to each other, as well as coupling the first four-way connector 18 to the second four-way connector portion 44. At this time, the user may dispose a respective pin portion 58 through each outside end 15 aperture 26 of the base rail portions 36, 40 and through the apertures 26 of the respective ends of the attachment portion, thereby preventing the attachment portion (i.e., either the attachment portion 38 or the attachment portion 32, dependant upon which one the user selected to couple to the base rail portions 36, 40) from becoming disengaged with the base rail portions 36, 40.

Next, the user 90 would locate the first and second post portions 20, 48, dispose a respective one of the post portions upon the vertical connector 100 of the first four-way connector portion 18, and dispose the remaining respective one of the post portions upon the vertical connector portion 100 of the second four-way connector portion 44. The user 90 then would locate the first and second three-way connectors 22, 50 and dispose a respective vertical post connector portion 112 within each of the respective post portions 20, 48, such that the respective support rail connector portions 110 face each other and are positioned over a respective one of the base rail portions 36, 40. At this time, the user 90 may dispose a pin portion 58 through each of the apertures 26 of the bottom end 19 and top end 21 of the post portions 20, 48 and through the apertures 26 of each respective vertical connector portion 108, 112 of the three-way connector portions 22, 50, thereby preventing each of the three-way connector portions 22, 50 from becoming disengaged with the post portions 20, 48.

The user 90 then may locate the first and the second support rail portions 30, 34, dispose a respective one of the support rails 30, 34 upon the support connector portion 110 of the first three-way connector 22, and dispose the remaining respective one of the support rails 30, 34 upon the support connector portion 110 of the second three-way connector 50. At this time, the user may dispose a pin portion 58 through each of the inside end 17 apertures 26 of the support rail portions 30, 32, and through the apertures 26 of the respective first and second vertical post connector portions 108, 112, of each respective three-way connector portion 22, 50, thereby preventing the support portions 30, 34 from becoming disengaged from the three-way connector portions 22, 50.

Next, the user would locate the remaining attachment portion of the respective attachment portions 32, 38, and dispose the respective ends of the attachment portion into the outside ends 15 of the support rail portions 30, 34. At this time, the user 90 may dispose a pin portion 58 through the outside end 15 apertures 26 of the support rail portions 30, 34 and through the apertures 26 of the attachment portion (i.e., the remaining attachment portion of the attachment portions 32, 38), thereby ensuring that the attachment rail portion will not disengage from the support rail portions 30, 34.

The user 90 then would locate the first and second wire post portions 24, 52, dispose a respective one of the wire post portions 24, 52 upon the vertical connector portion 108 of the first three-way connector portion 22, such that the guide wire containment pins 28 are parallel to and above the support rails 30, 34. The user 90 would then dispose the remaining respective wire post portion 24, 52 upon the vertical connector 108 of the second three-way connector portion 50, such that the plurality of guide wire containment pins are parallel to and disposed over the support rail portions 30, 34. At this time, the user 90 may dispose a pin through each of the bottom end 19 apertures 26 of the wire post portions 24, 52, and through the apertures 26 of the vertical connector portions 108 of the first and second three-way connector portions 22, 50, thereby ensuring that the wire post portions 24, 52 will not become disengaged form the three-way connector portions 22, 50. After the aforementioned set-up steps have been completed, the user has finished setting up the frame portion 12 of the assembly 10.

Next, the user would attach the guide wire portion 60 to a selected one of the guide wire containment pins 28 (e.g., the spring portions 62, 64 include a conventional hook) of the first wire post portion 24 by coupling the first spring portion 62 to the selected containment pin 28. The user 90 then would attach the spring portion 64 to a selected containment pin 28 of the second wire post portion 52, thereby coupling the guide wire to the frame portion 12. It should be understood that each of the equidistantly spaced plurality of apertures 26 of the wire post portions 24, 52 allow a user to select a proper height of the wire 60 for a batter, such as user 90 of a certain height. That is, if a batter is substantially tall (e.g., approximately six feet tall), the batter would connect the guide wire 60 upon the wire containment pins 28 which are located in close proximity to the upper ends 21 of the wire post portions 24, 52, thereby ensuring that the wire portion 60 is substantially near to or approximately within the batter's strike zone (e.g., conventionally determines to be from a batter's knees to the batter's chest or shoulders).

It should be appreciated that the assembly 10 is non-gender specific (i.e., both male and female individuals may utilize the assembly 10), and may be utilized to repeatedly practice a flat and level swing (i.e., a line-drive swing), a rising swing (i.e., a home-run swing), and a sinking swing (i.e., a ground-ball swing), simply by adjusting the guide wire 60 to either be parallel to the support rail portions 30, 34 (i.e., line-drive swing), adjusting the guide wire 60 to start at a lower containment pin 58 and rise to a higher containment pin 58 (i.e., home-run swing), or start at a higher containment pin 58 and end at a lower containment pin 58 (i.e., ground-ball swing). It should also be appreciated that the assembly 10 may be utilized by either right handed individuals, left handed individuals, or ambidextrous individuals without having to adjust any portion of the assembly 10.

In the abovedescribed manner, a batter or user 90 may repeatedly practice a certain desired swing with the bat 70 and ball 68 thereby allowing the batter or user 90 to retain the muscle memory that is required to perform a desired swing, effective to allow the individual or batter 90 to effectively utilize the same practiced motion within a game situation. That is, only a correct swing with bat 70 will allow the channel 76 to receive the guide wire 60, thereby allowing the striking surfaces 72, 74 to engage the ball 68 and forcibly propel the ball 68 along the wire 60. If struck correctly, the ball 68 will traverse the wire 60 until it impacts the stopper disk 66 and rests within the position generally shown as reference FIG. 69.

If the batter does not produce a correct swing, the channel 76 of the bat 70 will not receive the guide wire 60. If, by chance, the batter does contact the top or bottom of the ball 68 with either of the striking surfaces 72, 74, of the bat 70, the ball 68 will not be propelled to the end of the wire 60. That is, only a direct hit with a proper swing line will cause the ball to be desirably propelled to the end of the wire 60. Upon a batter 90 continually executing a correct swing line, the batter's muscles will "remember" the correct swing line and effectively be able to reproduce that desired motion without the assembly 10 (e.g., in a game-type situation).

It should be understood that this invention is not limited to the exact construction or embodiments listed and described, but that various changes may be made without departing from the spirit and scope of the invention.

What is claimed is:

1. An assembly comprising:

a frame portion having at least two wire containment pin portions, and wherein said at least two wire containment pin portions comprise a plurality of selectively removable wire containment pin portions;

a ball portion having an aperture formed therethrough;

a guide wire portion which is disposed through said aperture of said ball portion, said guide wire portion including two substantially identical attachment portions, said two substantially identical attachment portions each being disposed upon a unique end of said guide wire portion, and wherein said two substantially identical attachment portions each comprise a spring having a hook portion;

a bat portion having a handle end and a striking end, wherein said striking end includes a channel portion, and wherein said channel portion lies on a longitudinal axis of symmetry of said bat portion; and wherein said frame portion further comprises:

at least one pair of identical leg portions each having at least two apertures formed therethrough;

at least two identical base rail portions each having at least two apertures formed therethrough;

at least two support rail portions each having at least two apertures formed therethrough;

at least two vertical post portions each having at least two apertures formed therethrough; and at least two wire post portions each having a plurality of equidistantly spaced apertures formed therethrough.

2. The assembly of claim 1 wherein said frame portion further comprises:

at least two four-way connector portions; and at least two three-way connector portions.

3. The assembly of claim 2 wherein said at least two four-way connector portions comprise:

a vertical connector having an aperture formed therethrough;

a first leg connector having an aperture formed therethrough;

a second leg connector having an aperture formed therethrough; and a third leg connector having an aperture formed therethrough, wherein said first, second, and third leg connectors are perpendicular to the vertical leg connector, and wherein said first and said second leg connectors form a ninety degree angle, said second and said third leg connectors form a ninety degree angle, and said first and said third leg connectors form a one-hundred and eighty degree angle.

4. The assembly of claim 3 wherein said at least two three-way connector portions comprise:

a first vertical post connector portion having an aperture formed therethrough;

a second vertical post connector portion having an aperture formed therethrough; and a support connector portion having an aperture 26 formed therethrough, wherein said support connector portion is disposed upon said first and said second vertical post connectors at a ninety degree angle.

5. The assembly of claim 4 wherein said guide wire portion further comprises a pair of identical and selectively malleable stopper portions, each of said pair of identical and selectively malleable stopper portions being movably coupled to said guide wire portion at a unique end of said guide wire portion.

6. A method for using a sports training/practice assembly to increase hand-eve coordination and muscle memory, said method comprising the steps of:

providing a frame portion having at least two wire containment pin portions;

providing a ball portion having an aperture formed therethrough;

providing a guide wire portion and movably disposing said guide wire portion through said aperture of said ball portion;

providing two substantially identical attachment portions and coupling said two substantially identical attachment portions to a unique end of said guide wire portion and wherein said step of providing two substantially identical attachment portions further comprises the step of providing a pair of springs each having a hook portion;

providing a bat portion having a handle end, a striking end, and a longitudinal axis of symmetry;

forming a channel portion on said longitudinal axis of symmetry of said bat portion and through said striking end;

suspending said guide wire portion between said frame portion;

repeatedly swinging said bat portion at said ball portion, such that said channel portion of said bat portion receives said guide wire portion and allows said bat portion to strike said ball portion, effective to repeatedly practice a correct swing and gain muscle memory from said correct swing; and wherein said step of providing a frame portion further comprises the steps of:

providing at least one pair of identical leg portions and forming at least two apertures therethrough;

providing at least two identical base rail portions and forming at least two apertures therethrough;

providing at least two support rail portions and forming at least two apertures therethrough;

providing at least two vertical post portions and forming at least two apertures therethrough;

providing at least two wire post portions and forming a plurality of equidistantly spaced apertures therethrough;

providing at least two four-way connector portions; and providing at least two three-way connector portions.

7. The method of claim 6 wherein said step of providing at least two four-way connector portions further comprises the steps of:

providing a vertical connector and forming an aperture therethrough;

providing a first leg connector and forming an aperture therethrough;

providing a second leg connector and forming an aperture therethrough; and providing a third leg connector and forming an aperture therethrough.

8. The method of claim 7 wherein said step of providing at least two three-way connector portions further comprises the steps of:

providing a first vertical post connector portion and forming an aperture therethrough;

providing a second vertical post connector portion and forming an aperture therethrough; and providing a support connector portion and forming an aperture therethrough.

9. The method of claim 8 further comprising the steps of:

adjustably coupling said guide wire portion to said frame portion from a first low point to a second higher point; and repeatedly swinging said bat portion at said ball portion of said guide wire portion, thereby repeatedly practicing a home-run swing, effective to train muscles to remember said home-run swing.

10. The method of claim 8 further comprising the steps of:

adjustably coupling said guide wire portion to said frame portion from a first mid-point to and equal mid-point point; and repeatedly swinging said bat portion at said ball portion of said guide wire portion, thereby repeatedly practicing a line-drive swing, effective to train muscles to remember said line-drive swing.

11. The method of claim 8 further comprising the steps of:

adjustably coupling said guide wire portion to said frame portion from a first high point to a second low point point; and repeatedly swinging said bat portion at said ball portion of said guide wire portion, thereby repeatedly practicing a ground-ball swing, effective to train muscles to remember said ground-ball swing.

* * * * *